US005934818A

United States Patent [19]

Schmitt et al.

[11] Patent Number: 5,934,818

[45] Date of Patent: Aug. 10, 1999

[54] SCREEN CONNECTOR

[75] Inventors: Ralf Schmitt; Hans-Josef Kollmann, both of Minden, Germany

[73] Assignee: WAGO Verwaltungsgesellschaft mbH, Germany

[21] Appl. No.: 09/057,130

[22] Filed: Apr. 8, 1998

[30] Foreign Application Priority Data

Apr. 12, 1997 [DE] Germany ..... 197 16 762

[51] Int. Cl.[6] ..... B25G 3/36

[52] U.S. Cl. ..... 403/399; 403/396; 439/98; 439/812

[58] Field of Search ..... 403/399, 398, 403/400, 396, 384, DIG. 9, 322.1, 321, 389, 390; 439/98, 100, 810, 811, 812, 814, 815; 174/40 CC, 135; 24/525, 569

[56] References Cited

U.S. PATENT DOCUMENTS

| | | | |
|---|---|---|---|
| 2,127,862 | 8/1938 | Gebs | 403/290 |
| 2,199,076 | 4/1940 | LaSota | 403/290 |
| 4,694,544 | 9/1987 | Chapman | 403/290 X |

FOREIGN PATENT DOCUMENTS 89 00 058 4/1989 Germany .

OTHER PUBLICATIONS

Phoenix Contact Innovation in Interference. (No Date).

*Primary Examiner*—Lynne Reichard
*Assistant Examiner*—David E. Bochra
*Attorney, Agent, or Firm*—Salter & Michaelson

[57] ABSTRACT

A screen connector for engaging a cable, including an uncovered cable screen, positioned on a plate member is disclosed. The screen connector includes a clamp clip having at least two clamping legs which are spring-mounted relative to one another. The legs of the clamp clip encompass the plate member or busbar by lying opposite one another on the outside, whereby they engage the busbar from below, preferably by a coupling hook. The screen connector also includes a guide press piece having an outer and inner guide surface which slides along outer and inner guideways of the clamping legs when the guide press piece is moved to enclose the clamping legs. The guideways are shaped on the clamping legs in such a way that the clamping legs can be spring-mounted relative to one another when the guide press piece is in an upper initial position, and consequently can be locked onto the busbar in a perpendicular direction to the upper side of the busbar by means of their coupling hooks. In the other positions of the guide press piece deviating from the initial position and pulled up against the cable, the clamping legs are fixed relative to one another and consequently are joined solidly or undetachably with the busbar.

4 Claims, 2 Drawing Sheets

SCREEN CONNECTOR

TECHNICAL FIELD

The present invention relates to a screen connector for engaging a cable lying on a busbar, and more particularly to a clamp clip for engaging a cable screen lying on a busbar to provide a secure seating and contact of the cable screen against the busbar.

BACKGROUND OF RELATED ART

The screen support on a busbar (=reference potential) requires a large-surface, low-ohm (=HF-appropriate) contact of the busbar, which is also protected against corrosion of the lower wall surface. The screen connector, which is often to be arranged in a constricted space as close as possible to the conductor contact points of the individual conductors of a cable must fulfill the mechanical prerequisites for this connector. The manipulation and operability of such screen connectors are of basic importance.

In most of the usual cases of application, the busbar for the screen support extends in front of the conductor contact point, i.e., the busbar runs crosswise in front of a clamp arrangement (e.g., in the form of a row of clamps locked on a mounting rail) and the incoming and/or outgoing screened cables run above the busbar, so that the individual conductors of the cable can connect simply to the conductor contact points of the clamp arrangement. The screen connectors are mounted on the busbar only after wiring the individual conductors.

Screen connectors of the clamp clip type are described in DE 89 00058 U1. The busbar is formed there as a so-called C-rail, and the ends of the clamp clip each have two catch hooks pointing outwardly, which lock in the C-rail open toward the top. These screen connectors cannot be used for a busbar with a rectangular cross-section, since they always require the special rail in the form of a C-rail.

A screen connector of the clamp-clip type according to the above and known on the market (see screen connector SK of the Phoenix Co., D-32825 Blomberg) has on each of its two clamp-clip ends a larger hook, which can be slid onto a standard rectangular busbar from the side, whereby the hook engages the busbar from below over its entire width. This basically requires sufficient free space on the side next to the busbar, and this is true also, if it is attempted to place the clamp clip onto the busbar in a way that saves as much space as possible by the design of a combined turning and sliding motion.

The present invention takes on the task of developing a screen connector of the above-given type, which can be placed in the simplest way on the busbar, as much as possible, with perpendicular alignment to the upper side of the busbar to assure a secure seating and a permanent contacting of the cable screen on the busbar.

SUMMARY

The screen connector according to the present invention includes a clamp clip which is engageable over a cable lying on a plate member including an uncovered cable screen, the clamp clip ends being interlocked with the plate member such that a guide press piece moved against the cable by the clamp clip presses the cable with the uncovered cable screen against the plate member.

The clamp clip includes two ends proceeding from the back of the clamp clip, the two ends each being divided into two clamping legs which are spring-mounted relative to one another. The legs of the clamp clip encompass the plate member or busbar by lying opposite one another on the outside, whereby they engage the busbar from below, each leg preferably having a coupling hook. The press piece of the screen connector includes guide surfaces which slide along guideways of the clamping legs when the press piece is moved to enclose the clamping legs. The guideways are shaped on the clamping legs in such a way that the clamping legs can be spring-mounted relative to one another when the guide press piece is in an upper initial position, and consequently can be locked onto the busbar in a perpendicular direction to the upper side of the busbar by means of their coupling hooks. In the other positions of the guide press piece deviating from the initial position and pulled up against the cable, the clamping legs are fixed relative to one another and consequently are joined solidly or undetachably with the busbar.

According to the instructions of the invention, the clamp clip ends of the screen connector which are each formed by the two spring-mounted clamping legs are "forcibly controlled" by movement of the so-called guide press piece. The clamping legs can be very well adapted to their functions by this forcible control, and by placement of the screen connector onto a busbar, they are in other respects in a position in which the screen connector assures the qualitatively high-value contacting of the screen with the busbar.

In use, the new screen connector is delivered by the manufacturer to the user with a preadjustment of the guide press piece, which corresponds to the upper initial position of the guide press piece. In this as-supplied position or initial position, the ends of the clamping legs provided with the coupling hooks are somewhat braced in advance, so that the new screen connector can be placed without problem and with small force expenditure onto the busbar perpendicularly from the top, whereby the ends of the clamping legs or their coupling hooks are locked with the busbar.

As soon as the installer has moved the guide press piece of the screen support clamp in the direction onto the cable screen or the cable, the forcible control of the clamping legs is changed in such a way that these legs are found in a so-called locked position, in which the clamping legs are fixed relative to one another, i.e., they can no longer be sprung out relative to one another, so that the screen connector is now rigidly, i.e. undetachably, joined with the busbar. If later detachment of the screen connector or the demounting of the screen connector from the busbar is desired, the screen connector according to the invention is provided such that the guide press piece can be moved against an upper end stop, and in this end-stop position via the guide surfaces, the lower ends of the clamping legs provided with the coupling hooks spring apart from one another, so that the clamp can be removed from the busbar in a perpendicular direction.

BRIEF DESCRIPTION OF THE DRAWINGS

An example of embodiment of the invention will be described in the following in more detail on the basis of the drawings, wherein.

DETAILED DESCRIPTION OF THE EMBODIMENTS

Figure 1:
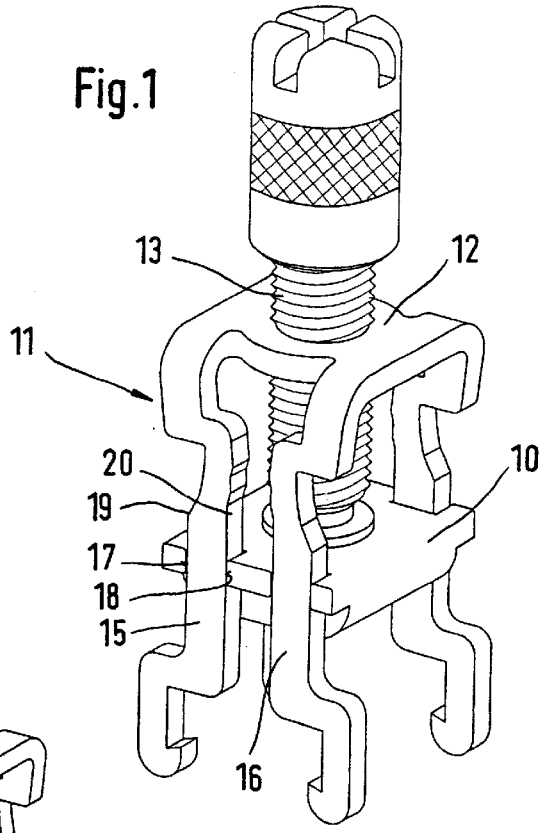
FIG. 1 shows in a perspective representation the new screen connector.
Figure 2:
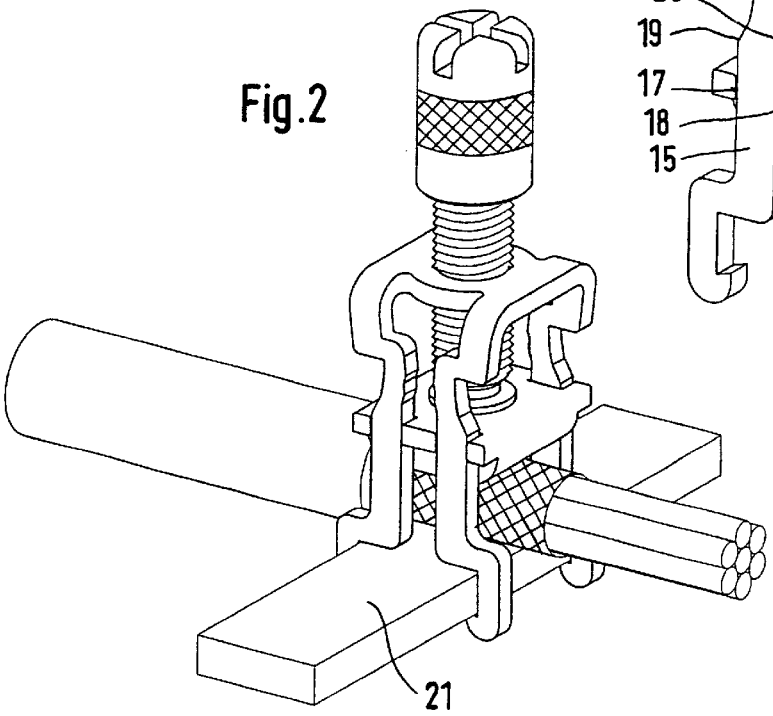
FIG. 2 shows the screen connector on a busbar.
Figure 3:
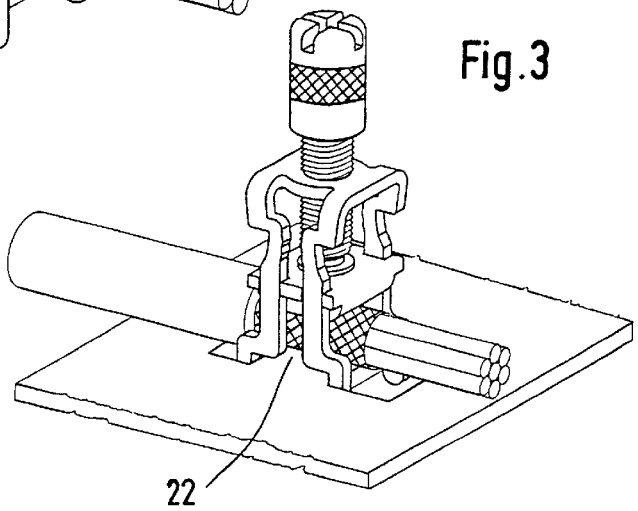
FIG. 3 shows the screen connector on a ground plate.
Figure 4:
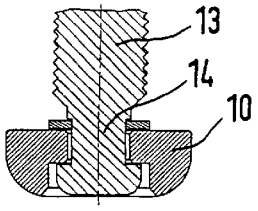
FIG. 4 shows the connection of the tightening screw with the guide press piece.

In one embodiment of the invention, shown in FIGS. 1–7, a screen connector 8 is provided including a guide press piece 10 and clamp clip 11. A tightening screw 13 is screwed through the clamp clip back 12, and the lower shaft end 14 of the screw 13 is preferably riveted in guide press piece 10 in a rotatable manner, as shown in FIG. 4.

Clamp clip 11 has on each side two clamping legs 15 and 16 arranged opposite one another, which can be spring-loaded relative to one another, when and insofar as guide press piece 10 permits this. According to the instructions of the invention, the guide press piece 10 is provided with guide surfaces 17 and 18, each of which enclose one clamping leg. With an adjustment motion of guide press piece 10, which is undertaken by means of tightening screw 13, guide surfaces 17 and 18 slide along guideways 19 and 20 of the clamping legs, in such a way that the admissible or non-admissible spring path of the clamping legs is forcibly controlled as explained in greater detail below with reference to FIGS. 5 to 7.

FIG. 2 shows the screen connector 8 locked onto a busbar 21, and FIG. 3 shows the screen connector 8 locked onto a cross-piece 22, which is rectangular in cross-section and is stamped from a housing plate of a device, from an assembly plate, or from a special plate with ground connection ( i.e., a ground plate).

Figure 7:
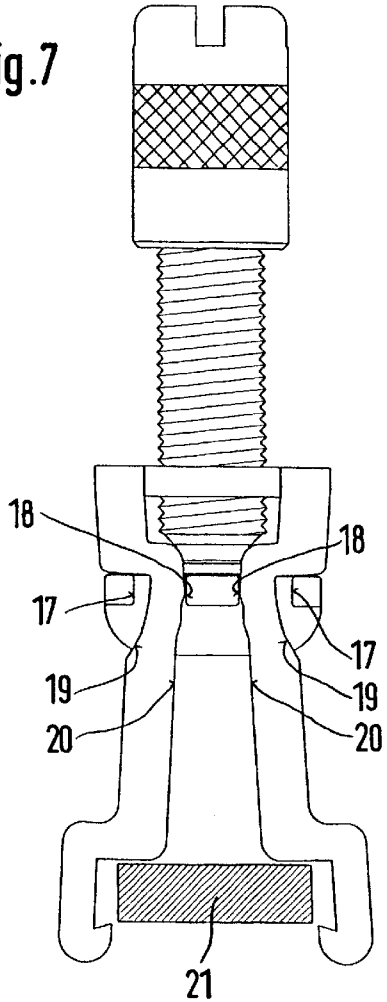
FIGS. 5–7 show different positions of the guide press piece.
Figure 6:
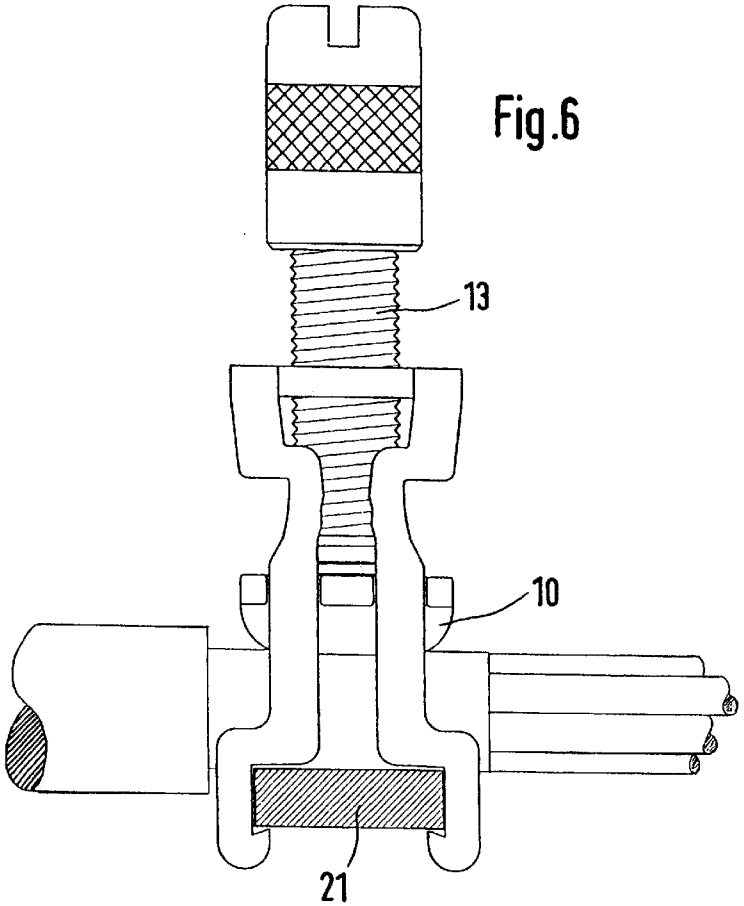
Figure 5:
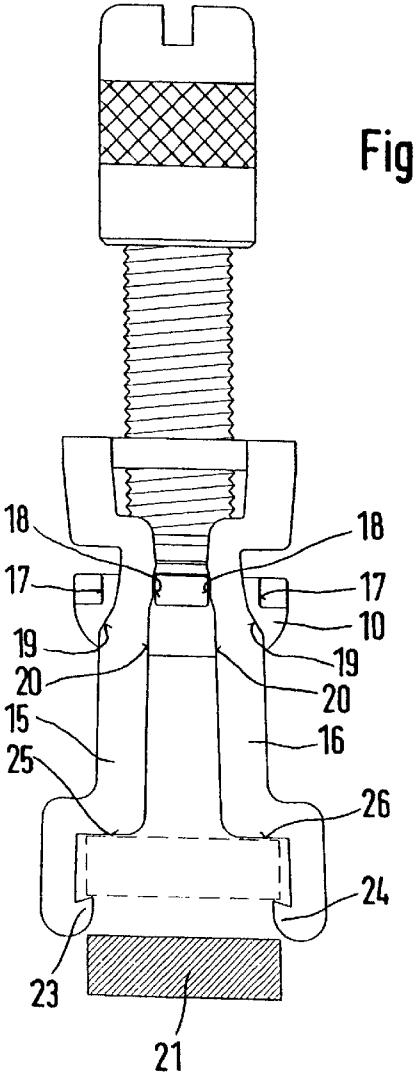

Referring now to FIGS. 5 to 7, side views of the screen connector 8 with guide press piece 10 in different positions are illustrated. The initial position of guide press piece 10 is shown in FIG. 5. The screen connector is preferably supplied by the manufacturer to the user with the guide press piece in the initial position, or the "as-supplied" position. In the initial position, guide surfaces 17 of guide press piece 10 are positioned outside, or at a distance from the outer guideways 19 of legs 15 and 16. In this position, the spring path of clamping legs 15 and 16 are released in an outer direction. In other words, guide surfaces 17 are spaced from outer guideways 19 so that the inner-lying guide surfaces 18 may press clamping legs 15 and 16 somewhat in the direction toward the outside by means of the appropriately shaped inner guideways 20. This leads to a so-called bracing in advance of the lower ends of the clamping legs 15, 16 which are provided with coupling hooks 23 and 24, so that the latter can be locked without problem and without great force expenditure onto busbar 21 vertically from top to bottom in the presentation shown in FIG. 5. The busbar in the position after locking is depicted by the dotted line in FIG. 5. After this initial locking, the lower ends of the clamping legs 15, 16 engage the outer contour of the busbar in an extensively form-fitting manner, and particularly the depicted lower leg pieces 25 and 26 are applied in a planar position onto the upper side of the busbar, so that the seating of the clamp on the busbar is already well stabilized now after the initial locking.

FIG. 6 shows guide press piece 10 in the so-called locked position. In this position, the guide press piece is advanced by means of tightening screw 13 against the uncovered screen 27 of the cable and presses the latter over a large surface against busbar 21. The new screen connector is "locked" (i.e., the locked position) against unintentional detachment from the busbar 21, in such a way that all guide surfaces 17 and 18 of the guide press piece lie closely on guideways 19 and 20 of the clamping legs and fix these in place relative to one another.

FIG. 7 shows the guide press piece in its upper end or stop position, in which the guideway of the clamping leg is released in the direction toward the outside (i.e., guide surfaces 17 have a greater distance to outer guideways 19) and the lower leg ends are spread apart from one another by means of guide surfaces 18 lying inside against inner guideways 20, so that the screen connector can be removed from busbar 21 without problem vertically from bottom to top in the representation shown in FIG. 7.

In use, the new screen connector is delivered by the manufacturer to the user with a preadjustment of the guide press piece, which corresponds to the above-named upper initial position of the guide press piece (FIG. 5). In this as-supplied position or initial position, the ends of the clamping legs provided with the coupling hooks are somewhat braced in advance, so that the new screen connector can be placed without problem and with small force expenditure onto the busbar perpendicularly from the top, whereby the ends of the clamping legs or their coupling hooks are locked with the busbar. In this way a rapid and problem-free premounting of the new screen connector to be produced on the busbar is possible. The locking from the vertical direction onto the upper side of the busbar requires no additional free space on the side next to the busbar, so that the new screen connector can also be very well applied under very constricted space conditions.

After this premounting, the screen connectors may be aligned on the busbar, but they are already sufficiently securely attached onto the busbar, so that an installer can work with them as is, i.e., the guide press piece of the screen connector can be moved in the direction of the cable screen or of the cable, in order to attach the latter onto the busbar.

In order to support a stable, assembly-friendly position of the new screen connector on the busbar, the lower ends of the clamping legs are provided with coupling hooks that engage the outer contour of the busbar in an essentially form-fitting manner, particularly with a lower leg piece applied in a planar manner onto the upper side of the busbar, and this piece additionally stabilizes the seating of the connector on the busbar.

As soon as the installer has moved the guide press piece of the screen support clamp in the direction onto the cable screen or the cable, which can be produced in the known way by means of a tightening screw screwed via the back of the clamp clip, the forcible control of the clamping legs is changed in such a way that these legs are found in a so-called locked position, in which the clamping legs are fixed relative to one another, i.e., they can no longer be sprung out relative to one another, so that the screen connector is now rigidly (undetachably) joined with the busbar (FIG. 6). In this locked position of the screen connector, the installer can move the guide press piece with any desired compressive force against the cable screen or the cable by further rotating the tightening screw, without the danger that the new screen connector might detach from the busbar.

In practice, however, circumstances arise, in which the later detachment of the screen connector or the demounting of the screen connector from the busbar is desired. In order also to be able to undertake this task in the advantageous perpendicular direction relative to the busbar, another improvement of the screen connector according to the invention is provided such that the guide press piece can be moved against an upper end stop, and in this end-stop position via the guide surfaces, the lower ends of the clamping legs provided with the coupling hooks spring apart from one another, so that the clamp can be removed from the busbar in a perpendicular direction (FIG. 7).

The guide press piece, which effects the forcible control of the clamping legs with its guide surfaces according to the instructions of the invention, and in the known way also effects the contact positioning of the cable screen on the busbar as a press piece, can be designed in a spring-loaded way in and of itself, in order to equilibrate possible changes in shape of the cable during permanent pressure on the cable. In the usual case, however, a press piece that is spring-loaded in and of itself is not necessary, since the entire structure of the new screen connector of the clamp-clip type has a certain intrinsic resilience. In special cases, it may be provided that the tightening screw screwed via the back of the clamp clip is combined with the guide press piece by means of an intermediate connection of a spring element that is spring-loaded in the direction of the screw axis, in order to equilibrate possible changes in the shape of the cable.

It will be understood that various modifications may be made to the embodiment disclosed herein. Therefore, the above description should not be construed as limiting, but merely as exemplifications of a preferred embodiment. Those skilled in the art will envision other modifications within the scope spirit of the invention.

We claim:

1. A screen connector for clamping a screened cable with an uncovered part of the its screen against a busbar, the screen connector comprising:

a U-shaped clamp clip having a first end and a second end, each of the first and second ends including at least two clamping legs spring-loaded against each other, each of the at least two clamping legs including an end portion having a coupling hook configured and arranged to engage the busbar from below and further including an outer and an inner guideway;

an adjustable guide press piece including an outer guide surface and an inner guide surface, the outer and inner guide surfaces each being constructed and arranged to engage the outer and inner guideways of the at least two clamping legs;

a tightening screw disposed through a back portion of the clamp clip and engageable with the guide press piece to move the guide press piece along the outer and inner guideways of the clamping legs;

wherein positioning the guide press piece in an upper initial position so that the outer guide surface of the guide press piece is spaced from the outer guideway of the at least two clamping legs allows the clamping legs to be spring mounted relative to one another so that the clamping legs can be locked onto the busbar, and wherein positioning the guide press piece in a locked position so that the outer and inner guide surfaces of the guide press piece engage the outer and inner guideways of the at least two clamping legs causes the at least two clamping legs to be fixed relative to each other such that the clamping legs can be joined to the busbar by the coupling hooks in order to lock the screen connector to the busbar.

2. The connector according to claim 1, wherein the clamp clip includes an upper end stop such that positioning the guide press piece against the upper end stop spaces the outer guide surface of the guide press piece from the outer guideway of the at least two clamping legs so that the inner guide surface of the guide press piece presses against the inner guideway of the at least two clamping legs to move the lower ends of the clamping legs apart to release the coupling hooks from the busbar so that the screen connector can be removed from the busbar in a vertical direction.

3. The connector according to claim 1, wherein each of the clamping legs includes a lower leg portion that is engageable with the upper surface of the busbar in a planar manner so as to further stabilize the seating of the connector on the busbar.

4. A method of releasably engaging a screen connector including a clamp clip having at least two clamping legs with outer and inner guideways and end portions configured and arranged to engage a plate member, and an adjustable guide press piece including an outer guide surface and a inner guide surface engageable with the outer and inner guideways of the at least two clamping legs with a cable disposed on a plate member, the cable including an uncovered cable screen, the method comprising:

positioning the guide press piece in an upper initial position so that the outer guide surface of the guide press piece is spaced from the outer guideway of the at least two clamping legs so that the clamping legs are spring mounted relative to each other;

positioning the guide press piece in a locked position such that the outer and inner guide surfaces of the guide press piece engage the outer and inner guideways of the at least two clamping legs so that the at least two clamping legs are fixed relative to each other and joined to the plate member by the end portions of the at least two clamping legs such to lock the screen connector to the plate member; and positioning the guide press piece against an upper end stop of the clamp clip so that the outer guide surface of the guide press piece is spaced from the outer guideway of the at least two clamping legs and the inner guide surface of the guide press piece presses against the inner guideway of the at least two clamping legs to move the lower ends of the clamping legs apart and release the end portions from the plate member so that the screen connector can be removed from the plate member.

* * * * *